US009167949B2

(12) United States Patent
Lemley

(10) Patent No.: US 9,167,949 B2
(45) Date of Patent: Oct. 27, 2015

(54) SONIC SILVERWARE WASHING METHOD

(71) Applicant: Shaun Lemley, Chicago, IL (US)

(72) Inventor: Shaun Lemley, Chicago, IL (US)

(73) Assignee: Shaun Lemley, Chicago, IL (US)

( * ) Notice: Subject to any disclaimer, the term of this patent is extended or adjusted under 35 U.S.C. 154(b) by 292 days.

(21) Appl. No.: 13/952,257

(22) Filed: Jul. 26, 2013

(65) Prior Publication Data

US 2013/0340790 A1 Dec. 26, 2013

Related U.S. Application Data

(63) Continuation-in-part of application No. 11/555,477, filed on Nov. 1, 2006, now abandoned.

(51) Int. Cl.

| | |
|---|---|
| ***A47L 15/50*** | (2006.01) |
| ***A47L 15/13*** | (2006.01) |
| ***A47L 15/00*** | (2006.01) |

(52) U.S. Cl.

CPC ..... *A47L 15/13* (2013.01); *A47L 15/0089* (2013.01); *A47L 15/502* (2013.01)

(58) Field of Classification Search

CPC ..... A47L 15/502

See application file for complete search history.

(56) References Cited

U.S. PATENT DOCUMENTS

| | | | | |
|---|---|---|---|---|
| 2,124,052 | A | 7/1938 | Clough | |
| 2,565,798 | A | 8/1951 | Borzell et al. | |
| 2,722,225 | A | 11/1955 | Carson | |
| 3,220,426 | A | 11/1965 | Brucken | |
| 3,460,878 | A | 8/1969 | Peterson et al. | |
| 3,465,761 | A | 9/1969 | Meeker et al. | |
| 3,469,586 | A | 9/1969 | Berson et al. | |
| 3,777,989 | A | 12/1973 | Pacella et al. | |
| 4,296,768 | A | 10/1981 | Saucedo | |
| 4,368,747 | A | 1/1983 | Taylor | |
| 4,557,283 | A | 12/1985 | Shaw | |
| 4,765,020 | A | 8/1988 | Weihe | |
| 5,184,635 | A | 2/1993 | Tromblee et al. | |
| 5,218,980 | A * | 6/1993 | Evans | A47L 15/0002 134/1 |
| 5,518,014 | A | 5/1996 | McEachen | |
| 5,593,507 | A * | 1/1997 | Inada | B08B 3/041 134/1 |
| 5,755,244 | A | 5/1998 | Sargeant et al. | |
| 6,092,540 | A | 7/2000 | Chiao | |
| 6,544,344 | B2 | 4/2003 | Hegeman et al. | |
| 6,742,531 | B2 | 6/2004 | Christman et al. | |
| 6,800,181 | B1 | 10/2004 | Accattato | |
| 7,003,843 | B1 | 2/2006 | Moore | |
| 2003/0205260 | A1 | 11/2003 | McConnell et al. | |
| 2004/0025702 | A1 | 2/2004 | Cutter et al. | |
| 2006/0096620 | A1 | 5/2006 | Bryne et al. | |

FOREIGN PATENT DOCUMENTS

| | | |
|---|---|---|
| JP | 54042860 | 4/1979 |

* cited by examiner

*Primary Examiner* — Jason Ko

(74) *Attorney, Agent, or Firm* — Miller, Matthias & Hull LLP

(57) ABSTRACT

The portable, compact, silverware washing apparatus is disclosed. The apparatus is manufactured so as to easily mount on top of a kitchen countertop or to be easily portable to other locales. The appliance is designed so as to not be connected to a water supply within a home or apartment, but rather rely upon the user to pour in an independent supply of water. The device includes a motor and pump assembly to fill a washing chamber with water and detergent, while a sonic transducer bombards the silverware loaded therein with sonic vibrations. The pump assembly automatically drains the water and waste after completion of the washing cycle. The appliance is configured with a specialized basket for holding the silverware in individualized compartments.

13 Claims, 8 Drawing Sheets

SONIC SILVERWARE WASHING METHOD

CROSS-REFERENCE TO RELATED APPLICATION

This application is a continuation-in-part of U.S. application Ser. No. 11/555,477 filed on Nov. 1, 2006.

FIELD OF THE DISCLOSURE

The present invention generally relates to kitchen appliances and, more particularly, relates to kitchen appliances adapted to sonically wash silverware.

BACKGROUND OF THE DISCLOSURE

Automated dishwashing appliances, commonly known as dishwashers, have been known for decades. Conventionally, such appliances are mounted underneath a kitchen countertop and are hard plumbed into water supply of the house or building to provide a hot and cold water supply to the appliance, and to drain rinse water and waste away. Conventionally, a hinged door is provided on a front surface of the appliance which pivots downwardly so as to be level with the floor and allow access of the user to the washing chamber of the appliance. One or more trays are slidably mounted within the washing chamber to facilitate loading of the tray with dishes of the homeowner. The trays are typically mounted on casters to facilitate the sliding action.

While effective, such floor mounted dishwashing appliances are relatively expensive. The appliances are expensive not only in terms of initial financial outlay, but also by way of the house or apartment needing to be physically plumbed to provide the water supply to the floor or wall adjacent the dishwasher. While this expense is reasonable for most, a large portion of the population cannot afford either the initial financial outlay or the cost of plumbing the house accordingly. This is especially the case in older homes or apartments wherein the plumbing is not already provided, but rather the living space must be retrofitted to accommodate the appliance.

It is also known to provide dishwashing appliances which are not mounted under a countertop, but rather are provided in a smaller format and adapted to be placed on top of a countertop, table or the like. Such units typically include some sort of housing which sits on top of a countertop, but otherwise has many of the same features of the aforementioned under-countertop dishwasher. One example is U.S. Pat. No. 3,465,761, issued to Meeker, which as shown best in its FIG. 1, includes a substantially rectangular box-like enclosure with a front door which hinges outwardly away from a front face of the appliance to provide access to a sliding tray provided therein. A motor and pump assembly is provided to spray water and detergent against the dishes mounted therein. However, the unit is designed to be directly connected into the water supply of the home or business. Again, this will accordingly result in added expense in that the house must be plumbed accordingly.

Other examples of countertop mounted portable dishwashers are disclosed in U.S. Pat. Nos. 3,469,586; 3,777,989; 5,184,635; 5,518,014; and 6,092,540, the latter three of which disclose the water supply being plumbed not to fixed copper conduit as would be the case of an under-counter mounted dishwashing appliance, but rather by way of a fixture mounted directly to the head of a faucet. For example, as shown in the aforementioned U.S. Pat. No. 5,518,104, the hose or other conduit is fed directly from the faucet tap to the dishwashing unit. Again, while effective, it necessarily requires that the appliance be mounted directly adjacent a sink. In addition, it necessarily occupies the sink during operation, thus preventing the sink from being used for further activities, requires the user to connect and disconnect the unit every time it is to be used, and is relatively unsightly in that the conduits are in plain sight, often dangling into the sink basin itself. In addition, none of the aforementioned dish washing appliances are truly portable in that they need to be connected to either a fixed plumbing supply within the house or building, or must be attached to a faucet as indicated above.

Additionally, while such countertop mounted dishwashing appliances are relatively effective, they are also relatively limited in their capacity to wash dishes. Simply based on their dimensions, only a relatively few number of dishes, glasses or pieces of silverware can be loaded therein. Moreover, while less expensive than the floor mounted or under-countertop mounted variety, such units are also sufficiently expensive so as to be precluded from purchase by a relatively large share of the population. For example, a 2003 U.S. housing survey indicated that roughly 40% of U.S. homes are not equipped with dishwashers and cannot afford such dishwashers. Accordingly, that large share of the population, typically comprised of the extremely poor or young, would benefit from a washing apparatus which is small in size, inexpensive, and truly portable.

In addition, existing dishwashers are typically very ineffective at cleaning silverware, prompting users to hand wash silverware before using the dishwasher to fully clean the silverware. Surveys have also shown that washing silverware is by far the most tedious and most undesirable phase of dishwashing and if only that phase can be automated, the consuming public would benefit. Finally, if such a device can be manufactured, it can be truly portable so as to be usable on trips, during camping, aboard RVs, and in other situations wherein the aforementioned appliances simply are not realistically feasible.

SUMMARY OF THE DISCLOSURE

Accordingly, the present disclosure provides a washing apparatus which is directed to cleaning silverware. Such a device can be manufactured to meet the foregoing goals including relatively small size and relatively low cost.

In accordance with one aspect of the disclosure, a method of sonically cleaning silverware is disclosed which comprises providing a housing having a washing chamber, a water reservoir, a transducer, a basket, a pump, a sump, and a microprocessor, loading silverware into the basket user end down, pouring water in the water reservoir, activating the microprocessor which has a data storage device containing a program that directs the microprocessor to operate the transducer and pump in a three stage operation having a first stage, a second stage, and a third stage, and indicating to a user that the cycle has finished. The first stage includes filling the washing chamber with water to a predetermined full level, activating the transducer to sonically bombard the silverware for a predetermined duration once the washing chamber is full, activating the pump at an end of the predetermined duration of the transducer activation to overflow the washing chamber with water from the reservoir, and activating the pump and sump, once the transducer has deactivated, for a predetermined duration to drain water and waste material from the washing chamber. The second stage includes, activating the pump to fill the washing chamber to about two-thirds of the full level with water from the reservoir, activating the transducer, once the washing chamber has received the water from the water reservoir, to sonically bombard the silverware for a predetermined duration activating the pump, once the transducer has deactivated, for a predetermined duration to drain water and waste material from the washing chamber. The third stage includes, activating the pump to fill the washing chamber to about one-third of the full level with water from the reservoir, activating the transducers, once the washing chamber has received the water from the water reservoir, to sonically bombard the silverware for a predetermined duration, and activating the pump, once the transducer has deactivated, for a predetermined duration to drain the washing chamber of water and waste material.

In accordance with another aspect of the disclosure, a method of sonically cleaning silverware is disclosed which comprises providing a housing having a washing chamber, a water reservoir, a transducer, a basket, and a pump, loading silverware into the basket, pouring water in the reservoir, and sonically cleaning the silverware in three stages. Each of a first stage, a second stage, and a third stage consisting of adding water to the washing chamber, activating the transducer to sonically bombard the silverware, and activating the pump to drain the water and waste material.

In accordance with still a further aspect of the disclosure, a portable washing machine configured to wash silverware is disclosed which comprises a housing, a washing chamber in the housing, a water reservoir in the housing, a transducer, a basket, a pump, and a microprocessor. The water reservoir being self-contained and including an inlet through which a user pours water prior to washing, the user poured water being the only source of water to fill the water reservoir. The transducer being mounted in the washing chamber such that sonic waves are directed into the washing chamber. The basket is removably mounted in the washing chamber and adapted to hold silverware. The pump communicates water from the water reservoir to the washing chamber. The microprocessor is configured to control the transducer and pump and has a data storage device containing a program directing the microprocessor to operate the transducer and pump in a first stage, a second stage, and a third stage.

These and other aspects and features of the disclosure become more apparent upon reading the following detailed description and taken in conjunction with the accompanying drawings.

Figure 1:
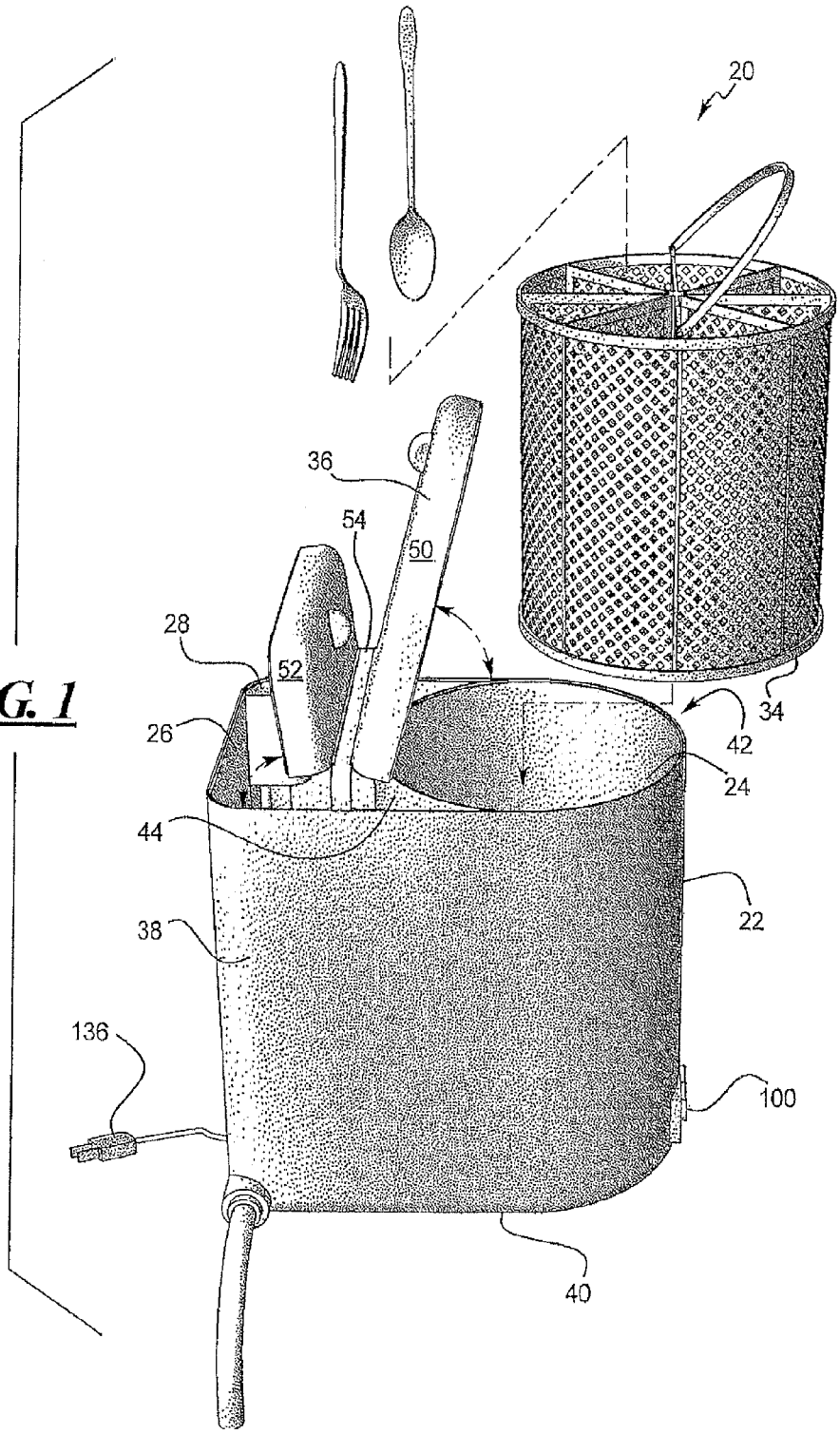
FIG. 1 is an exploded perspective view of an appliance constructed in accordance with the teachings of the disclosure.

While the present disclosure is susceptible to various modifications and alternative constructions, certain illustrative embodiments thereof have been shown in the drawings and will be described below in detail. It should be understood, however, that there is no intention to limit the present invention to the specific form disclosed, but on the contrary, the intention is to cover all modifications, alternative constructions, and equivalents falling within the spirit and scope of the present invention.

DETAILED DESCRIPTION OF THE DISCLOSURE

Referring now to the drawings and with specific reference to FIG. 1, a silverware washing apparatus constructed in accordance with the teachings of the disclosure is generally referred to by reference numeral 20. The apparatus 20 can be constructed in a number of different styles and formats but in any embodiment would be relatively compact in size, fully portable without any need to be connected to a water supply, inexpensive to manufacture, and adapted to wash silverware.

Figure 2:
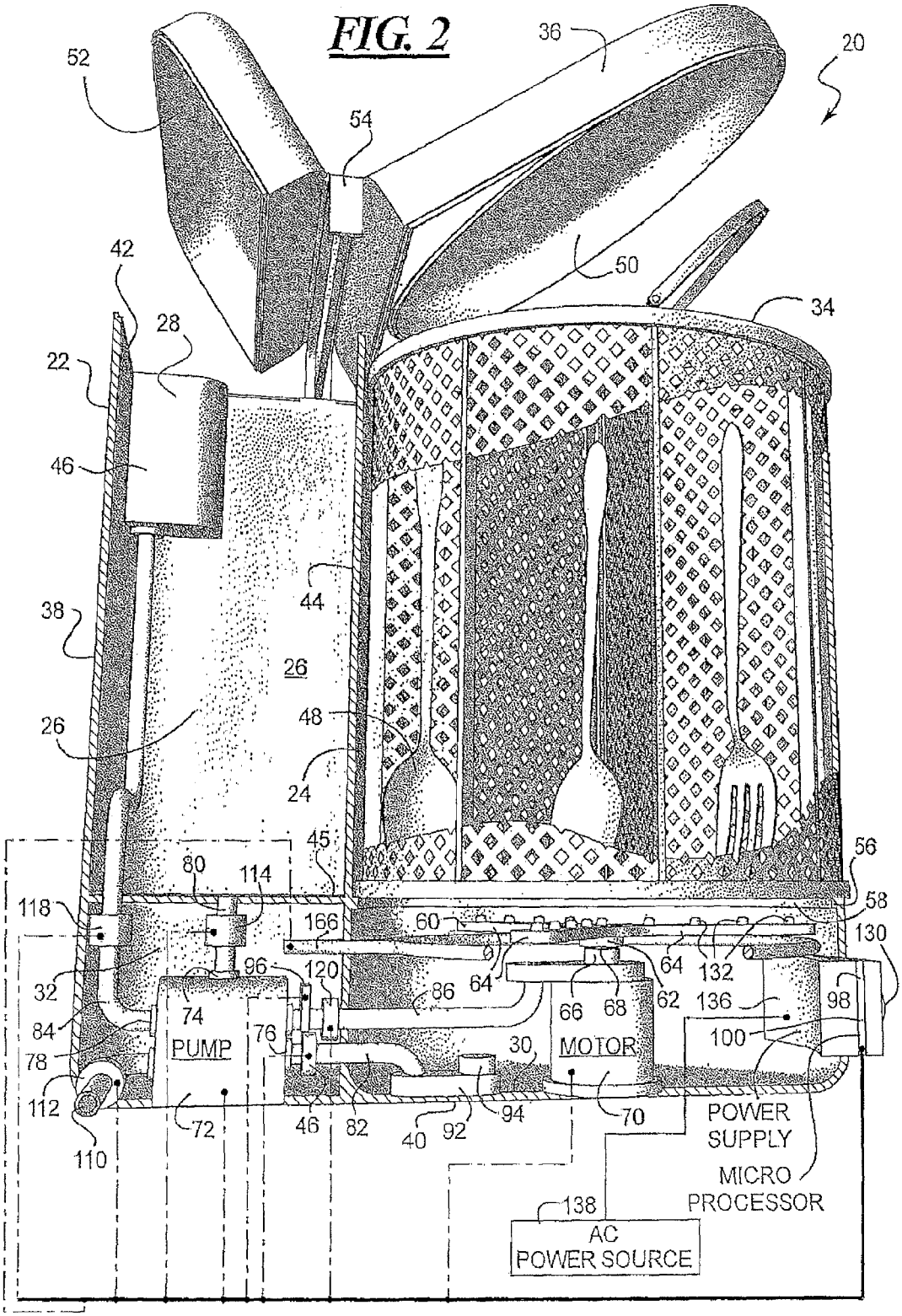
FIG. 2 is a sectional view of the appliance of FIG. 1.

As shown best in FIGS. 1 and 2, the appliance 20 may include a housing 22 having a washing chamber 24, a water reservoir 26, a detergent reservoir 28, a sump 30, a mechanical compartment 32, a basket 34, and a lid 36. Each of those elements will now be described in further detail herein. With reference now to the housing 22, it is shown to include side walls 38 with a closed bottom wall 40 and an open top 42. The housing can be manufactured from any number of different materials including plastic such as polypropylene, and metals such as stainless steel. With respect to dimensions, the teachings of the disclosure can be used to manufacture an appliance 20 of any conceivable dimension but in an effort to maintain the compact and inexpensive aspects of the appliance it is intended that the appliance 20 be manufactured at a size comparable to that of a modern residential coffee maker. For example, the appliance 20 may be approximately one cubic foot in size, but of course the appliance 20 could be manufactured to any dimension.

In order to form the washing chamber 24, an interior partition 44 is provided which upwardly extends from the reservoir bottom wall 45 between the side walls 38. Partition 44 in so doing not only forms the washing chamber 24, but a space for the water reservoir 26 and detergent reservoir 28 as well. With respect to reservoirs 26 and 28, the water reservoir 26 is substantially larger than the detergent reservoir, with the detergent reservoir 28 conceivably being simply a relatively small pocket 46 at the top of the water reservoir 26. As will be described in further detail herein, the water reservoir 26 is intended to be manually filled by the user prior to each use and thus needs to be of a sufficient size to hold a volume of water adequate to wash silverware 48 loaded therein. Due to the recycling nature of the appliance 20, the appliance 20 could, for example, include a water reservoir 26 adapted to hold approximately two gallons of water, but other volumes are certainly possible. Depending on the level of agitation of the water and detergent, for example, a much lesser volume could be employed, or for larger loads, a greater volume.

Access to the washing chamber 24, the water reservoir 26, and the detergent reservoir 28 is provided by way of the lid 36. As shown in the drawings, the lid 36 can be provided having a first cover 50 and second cover 52. The first and second covers 50, 52 can be hinged to a central plate 54 or could be hinged directly to one another. In the embodiment shown, the entire lid 36 would sit on top of the housing 22 with the central plate 54 overlaying the partition 44. Accordingly, when the user wishes to access the washing chamber 24, the first cover can simply be pivoted about the central plate 54 and similarly, when the user wishes to access the water reservoir 26 and/or the detergent reservoir 28, the second cover 52 can be similarly pivoted about the central plate 54. In an alternative embodiment, entire lid 36 can be of a single unitary piece of material which is entirely removed when any of the reservoirs are to be accessed.

Figure 5:
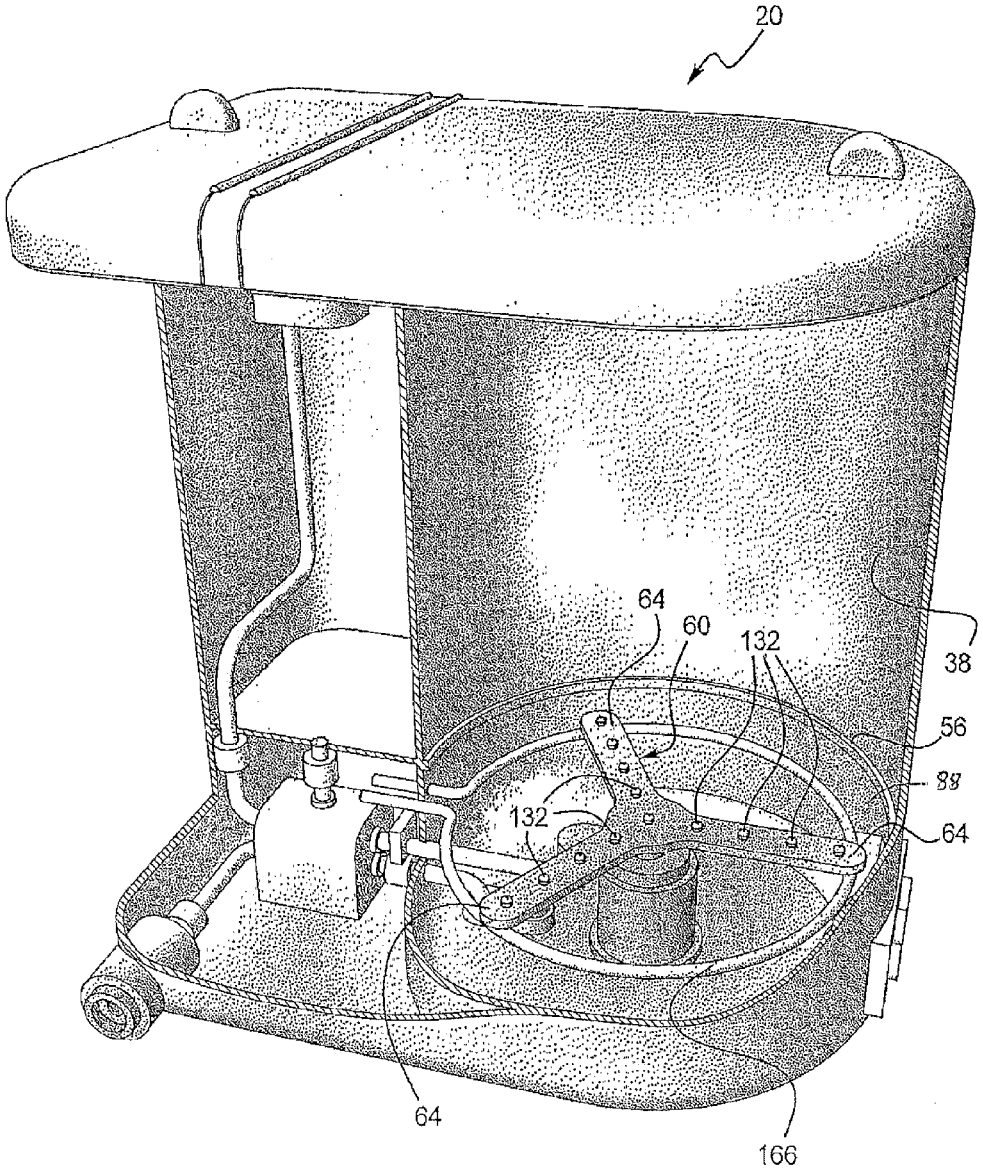
FIG. 5 is a cut-away view of the appliance of FIG. 1.

The washing chamber 24 further includes an inner ledge 56 on which the basket 34 is able to sit. The ledge 56 may extend around the entire inner circumference of the washing chamber 24 as shown in FIG. 5, or would be segmented at key locations there around. By positioning the basket 34 within the washing chamber 24 in such a manner, a space 58 is provided for a water jet 60. Alternatively, the ledge 56 need not be provided as part of the washing chamber 24, but rather the basket 34 could be provided with suitable legs, not shown, to raise the basket 34 within the washing chamber 24.

Referring now to FIG. 5, the washing chamber 24 is shown in cut-away fashion so as to view the water jet 60 in more detail. In the depicted embodiment, the water jet 60 is formed having a central hub 62 from which three legs 64 radially extend. Central hub 62 is mounted at a pivot 66 to a shaft 68 which in turn is connected to a motor 70. Accordingly, actuation of the motor 70 causes a shaft 68 to rotate which in turn causes the water jet 60 and its legs 64 to rotate as well above the central hub 62. In alternative embodiments, the water jet can be manufactured in a number of different forms including a single arm jet, a jet having more or less than three arms, a stationary jet, or one which is positioned elsewhere within the washing chamber 24 including above the basket 34.

In order to provide the water needed to clean the silverware 48, a pump 72 is provided proximate the motor 70 within the mechanical compartment 32. The pump 72 includes a first inlet 74 connected to the water reservoir 26, and a second inlet 76 connected to the sump 30. Accordingly, the pump 72 is able to draw water from multiple locations within the appliance 20. A third inlet 78 is provided so as to access the detergent reservoir 28. Conduits 80, 82 and 84 are used to connect the inlets 74, 76 and 78 to the water reservoir 26, sump 30, and detergent reservoir 28, respectively. Depending upon the sequence of operation, as will be described in further detail herein, the pump 72 draws water and/or detergent as needed. Upon actuation, the pump 72 provides either water or water and detergent to the water jet 60 by way of conduit 86.

In order to allow for the water sprayed against the silverware 58 to be recycled, the sump 30 is provided below the washing chamber 24. A large drainage and water spray access opening 88 formed by the radially inward perimeter of the ledge 56 allows for communication of water and waste from the washing chamber 24 to the sump 30. So as to avoid recirculation of waste from the sump 30 to the pump 72, a filter 92 may be provided within the second conduit 82. The filter 92 can be manufactured from any number of different materials including mesh, fibers, metallic screens, and paper layers, and is preferably positioned in such a manner so as to be easily accessible by the user for replacement as needed. In order to further facilitate such replaceable operation, the filter 92 can be slidably or otherwise removably mounted within the cartridge 94. The cartridge 94 can be itself fixedly attached to the second conduit 87 so that the filter 92 can simply be removed therefrom without requiring the user to connect and disconnect the cartridge from the second conduit line 76. In further embodiments, the appliance 20 can be manufactured without a filter all together. For example, the water detergent and waste could drain away after each cycle, in which case there may not be any need for a filter.

Also positioned within the mechanical compartment 32 is a heating element 96 provided so as to heat the water prior to being sprayed against the silverware 38. As the appliance 20 is designed to be operable with simple tap water poured in by a user, the inclusion of a heating element provides an added level of effectiveness. The heating element 96 can be provided by way of conventionally known heating technology including resistive heating, microwave heating, and ultrasonic heating. With the resistive heating element, the element itself could be provided directly within the water reservoir 26, whereas with the microwave and ultrasonic heating elements, they could be provided about one of the conduits 80 and 86 so as to heat the water as it flows therethrough. By isolating the volume of water being heated at any one time, using the rapid heating technology available through microwave and ultrasonic heating, the heating can be quick to the point of immediate.

Controlling operation of the appliance 20 is a microprocessor 98. The microprocessor would be in communication not only with the motor 70 and pump 72, but the heating element 96 and a user interface module 100 as well. In addition, the microprocessor 98 could be in communication with one or more sensors provided within the appliance 20 with examples including those informing the user that the filter needs to be replaced, that the cycles are completed, that the lid 36 is not properly shut, etc.

Figure 3:
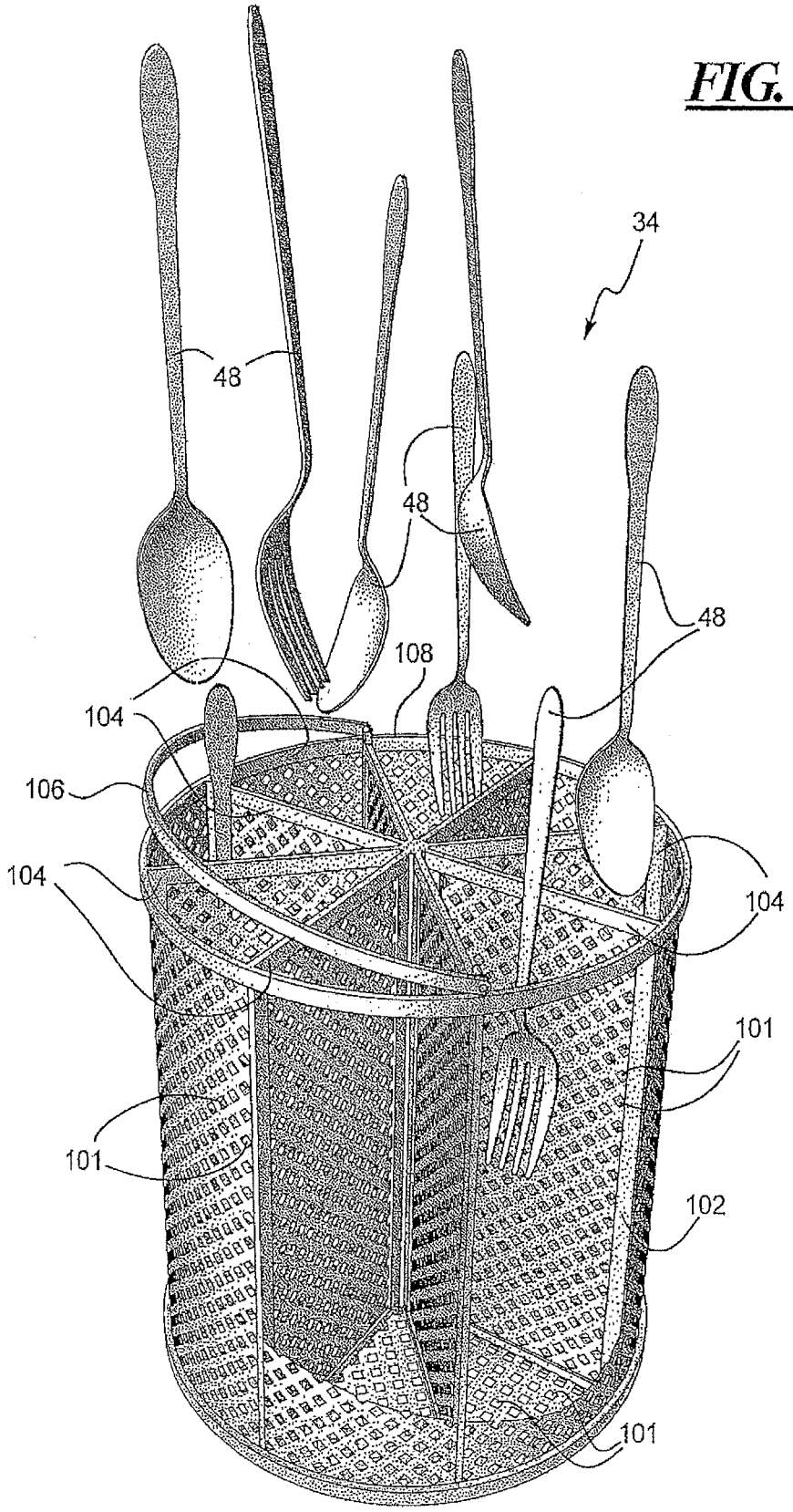
FIG. 3 is a perspective view of the basket of the appliance.
Figure 4:
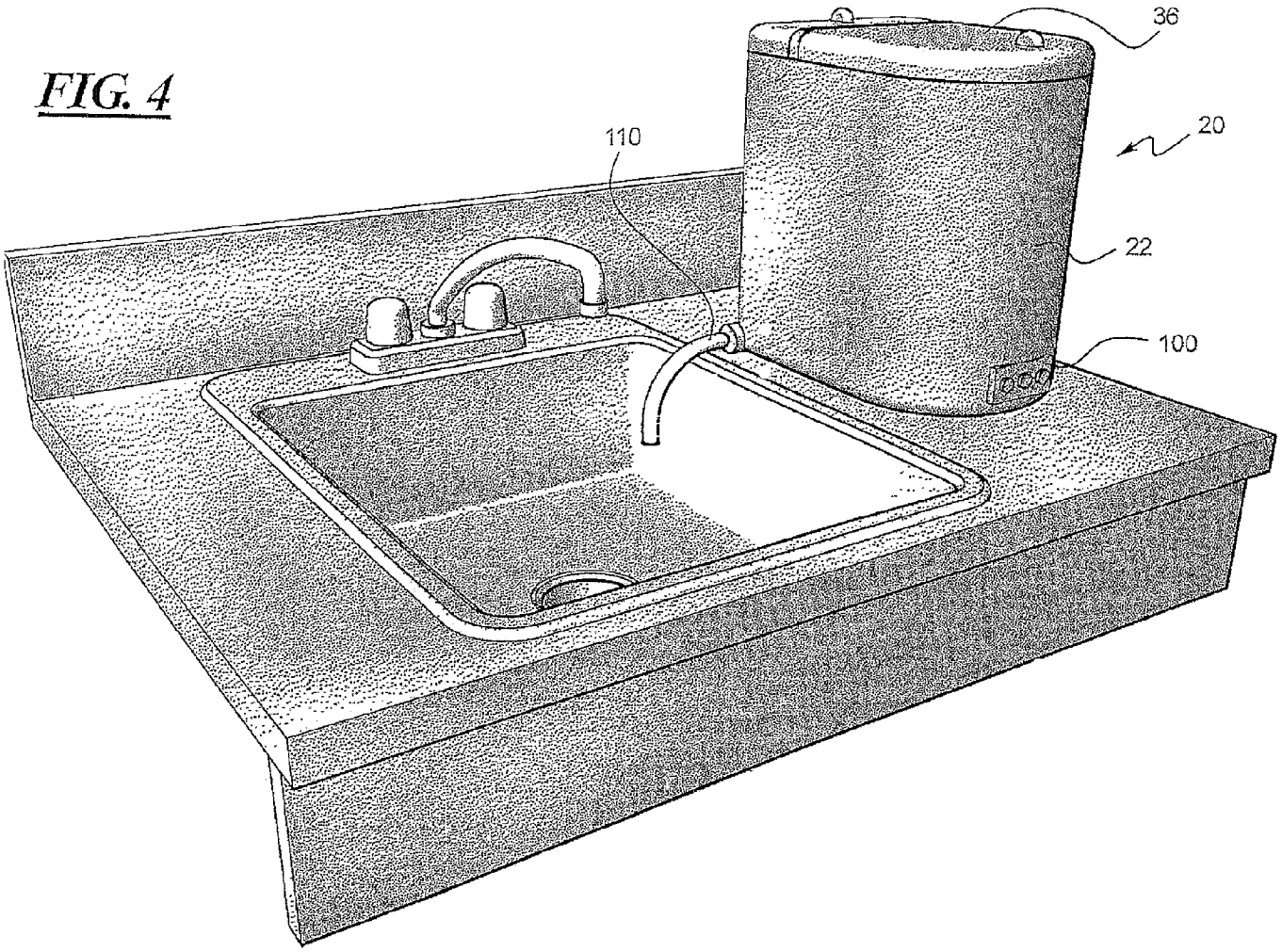
FIG. 4 is a perspective view of the appliance positioned proximate a sink.

Turning now to FIG. 3, the basket 34 is shown in more detail. In the depicted embodiment, the basket 34 is substantially cylindrical in shape matching that of the overall configuration of the washing chamber 24. However, in alternative embodiments, depending upon the construction of the washing chamber 24, the basket 34 can be manufactured in any number of different shapes including parallelepipeds. In addition, the basket 34 is constructed from a mesh or otherwise perforated material so as to allow for easy access of the water being sprayed by the water jet 60 to the silverware 48. For example, the basket could be manufactured from metal mesh or molded plastic having apertures 101 provided therein.

It is also important that the basket 34 include a plurality of individual compartments 102 for receipt of the silverware 48. The inventor has found that cleaning and effectiveness is improved if compartments 102 are provided for each individual piece of silverware. Moreover, the compartments 102 are provided in a vertical fashion to require that the individual pieces of silverware 48 are loaded therein and parallel to other pieces of silverware and separate therefrom.

Such disposition allows for the water sprayed by the jet 60 to impinge thereon at an effective angle and drain away therefrom at an effective angle as well. In order to provide the individual compartments 102, a plurality of partitions 104 can be provided within the basket 34. In the depicted embodiment, the partitions 104 are provided in radial fashion dividing the cross section of the basket 34 in pie fashion. But again, in an alternative embodiment, the partitions 104 can be provided in other shapes including those having a rectangular cross section, trapezoidal cross section, circular cross section, a honeycomb cross section, and the like. The partitions may be any dimension apart, with one effective example being one inch. Finally, the basket 34 is preferably manufactured having a handle 106 pivoted to an upper edge 108 of the basket 34 to allow the user to easily grasp and remove the basket 34 from the appliance 20. After placement into the washing chamber 24, the handle 106 can be pivoted as to be adjacent the upper edge wall 108 thereby allowing the lid 36 to be closed.

Referring again to FIGS. 1 and 2, it can be seen that the appliance 20 further includes a drain conduit 110. The drain conduit 110 is in communication with the washing chamber 24 and the water reservoir 26 and includes a valve 112 in electrical communication with the microprocessor 98. When the appliance 20 is in use, the valve 112 would be closed, thereby retaining all water within the appliance 20, and after the washing sequence is completed, the valve 112 can be opened to thereby allow gravity to drain the water from the appliance 20. If desired, the pump 72 can be employed to proactively force the water from the appliance 20 through the drain conduit 110. Valves 114, 116, 118, and 120 can also be provided in conduits 80, 82, 84, and 86, respectively, and can be opened by a microprocessor 98.

Figure 6:
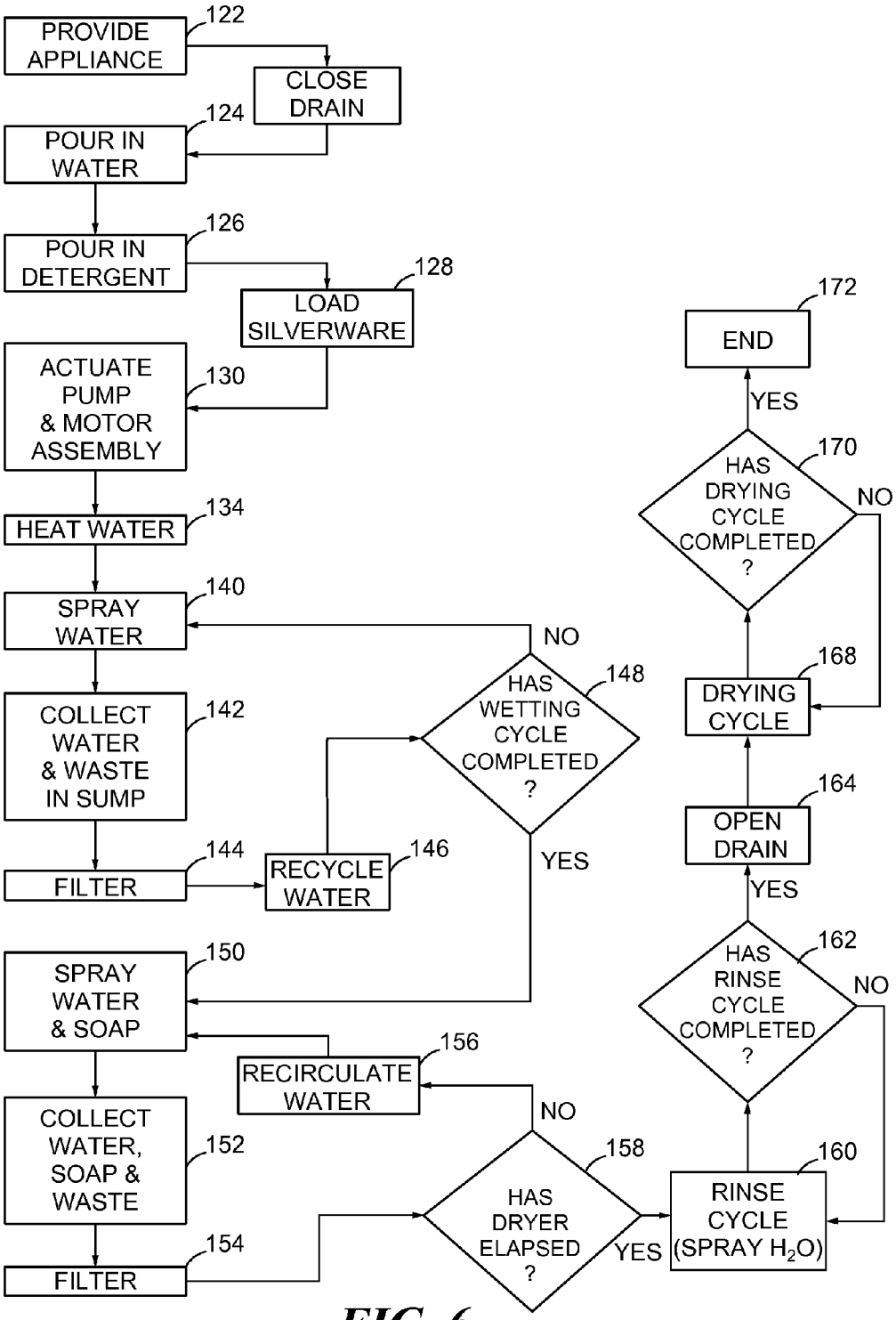
FIG. 6 is a flow chart depicting a sample sequence of steps which can be taken by an appliance constructed in accordance with the teachings of the disclosure.

Referring now to the flow chart of FIG. 6, a sample sequence of steps which can be employed by the appliance 20 and washing silverware 48 is shown in detail. It is to be understood that such a flow chart is representative of only one sample sequence of steps and that other permutations thereon can be employed and are encompassed within the teachings of this disclosure.

First, with respect to block 122, it could be seen that a first step is to simply provide the appliance 20. This would require the user to place the appliance 20, at least upon initial use, onto a countertop, preferably adjacent a sink, as shown best in FIG. 1. Alternatively, as the appliance 20 is designed to be truly portable, the appliance 20 can be placed anywhere for operation. For example, the user can take the appliance on a trip, camping or the like, wherein the appliance 20 can simply be placed on the ground. In a second step 124, a user lifts the lid 36 and pours water into the water reservoir 26. After completion of the previous washing cycle, the drain valve (as will be described in more detail below) will be closed as shown by a step 123. As indicated above, the appliance 20 is designed to be fully self contained and not require connection to a water supply and thus the reservoir 26 has been sized to accommodate sufficient water for a complete washing cycle. The inventor has found that approximately two gallons of water is sufficient for this purpose. In a third step 126, the user loads detergent into the detergent reservoir 28. Granular or liquid detergents would both be feasible. In a fourth step, either in subsequent steps to the water and detergent, or prior thereto, the user loads silverware 48 into the basket 34 as shown in step 128. This may either be done with the basket 34 already loaded into the washing chamber 24, or with the basket removed from the appliance 20, loaded with silverware and then reloaded back into the appliance 20.

Once each of the silverware and detergent are loaded into the appliance, the appliance 20 is activated by way of a switch 130. The switch 130 may be provided as part of the user interface module 100 or could be provided as a stand alone switch. Actuation of the switch 130 causes both the pump 72 and motor 70 to be activated as well, at the command of the microprocessor 98. The pump 72 initially draws water from the water reservoir 26. This in turn requires that the valve 170 positioned between the washing chamber 24 and the pump 72 to be opened at the command of the microprocessor 98. Such water is drawn by the pump 72 through the conduit 80 and then out through the conduit 86 to the water jet 60. The water is pressurized thereby and expelled from the nozzle apertures 132 provided in the legs 64 of the water jet 60. In addition, the microprocessor 98 in turn causes the motor 70 to be actuated, thereby causing the shaft 68 to rotate and in turn the water jet 60 to rotate. The combination of these steps causes water to be expelled upwardly against the silverware provided within the basket 34 in a swirling, rotational fashion, or vortex.

Prior to being sprayed, it is beneficial for the water to be heated, and thus the microprocessor 98 also causes actuation of the heating element 96 as shown by step 134 in FIG. 6. A power supply 136 is provided for connection to a conventional one hundred twenty volt AC power source 138. Alternatively, a battery (not shown) could be used to power the appliance. In FIG. 6, the spraying step is shown by box 140.

In a still further embodiment, additional cleaning water could be fed directly and constantly to each compartment 102. As opposed to the rotating water jet 60, which may intermittently hit the silverware 48, such a constant pressurized supply of water may further assist in cleaning. To provide for each an embodiment, the basket 34 may be provided with an integral manifold having a central nipple that fans out conduits to each compartment. The pump and its water supply could be connected directly to the nipple.

Once the silverware 48 is saturated by the sprayed water, the water and the waste that it collects from the silverware 48 will drain downwardly into the sump as shown by step 142. This water is then drawn by the pump 72 back through the filter 92 as shown by step 144 with the waste being cleaned by the filter 92 and the clean water being recycled back to the pump 72 as shown by step 146.

After a sufficient duration, as measured by a timer provided within the microprocessor 98 and shown in decision block 148, the pump 72 draws from the detergent reservoir 28 as well as the water reservoir 26. In so doing, soapy water is communicated from the water jet 60 against the silverware 48 for cleaning purposes, as shown in step 150. Soapy water is eventually drained from the silverware 48 into the sump 30 as shown by step 152. The soapy water is in turn run through the filter 92 (step 154) before being recirculated back to the water reservoir 26 as shown by step 156.

After a duration as measured by the microprocessor 98 (and shown by a step 158), the washing cycle is completed and the rinse cycle begins as shown by a step 160. In so doing, water from the reservoir 26 as well as filtered water from the sump 30, is sprayed against the silverware 48 by water jet 60. The microprocessor can be programmed to activate the heating element 96 during the rinse cycle if desired.

Again after a timed sequence as dictated by a microprossesor 98, the rinse cycle is completed as shown in step 162, and the water from both the water reservoir 26 and sump 30 can be drained from the appliance 20. This is shown by step 164 and effectuated by the opening of the valve 112, closing valves 114, 118, and 120 and operating pump 72. Alternatively, the drain can be gravity induced, or the user can simply upend the appliance over a sink or the like. Either in concurrence with the water draining or subsequent thereto, the silverware 48 can be dried by activating a resistive heating element 186 provided within the washing chamber 24 as shown by a step 168. Alternatively, the resistive heating element 166 need not be provided and the silverware can simply drain dry. In a still further embodiment, the basket 34 can be mounted within the housing 22 so as to enable the motor 70 to rotate the basket and by way of centrifugal force cause the water provided on the silverware 48 to be flung away and drained into the sump 30. However, in the depicted component, the heating element 166 is activated for a timed sequence as shown by a step 170. Once completed, the operator interface 100 can chime, illuminate or otherwise notify the user that the process is complete as shown by step 172 and that the silverware can be removed.

As for appearance and material selection, the embodiment depicted is but one example. The appliance housing could be manufactured from on opaque plastic, stainless steel, glass or a combination thereof. In one embodiment, the housing, or at least the washing chamber housing could be made of a transparent material to allow the viewer to see the appliance in action.

In another embodiment of the appliance 20, at least one transducer 200 is included to clean the silverware through sonic vibrations. In one embodiment, the sonic vibrations are provided at the ultrasonic level, i.e., powered at acoustic frequencies above the range audible to the human ear (above 20,000 hertz), but other sonic vibration ranges are possible.

Figure 7:
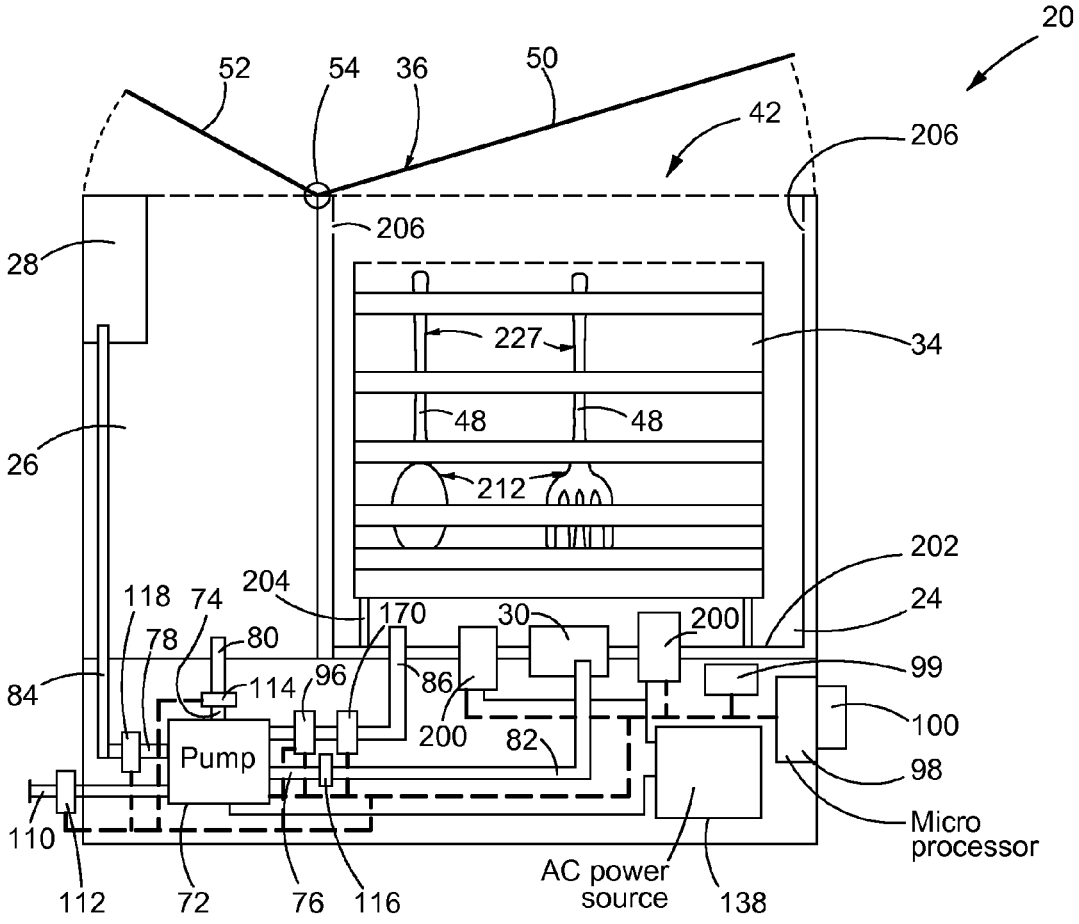
FIG. 7 is a schematic of a sonic appliance constructed in accordance with the teachings of the disclosure.

When immersed in a liquid, the transducers 200 generate sonic signals in the liquid; in this case the transducers 200 create sonic signals in the water in the washing chamber 24. These signals create vibrations in the water within the washing chamber 24 that bombard any silverware within the basket 34, causing any material that has adhered to the silverware to detach. Such a sonic dishwasher is illustrated in FIG. 7 and may include the previously described components as well as other components that will be further detailed herein.

The transducers 200 may be mounted in the washing chamber 24. While the transducers 200 may be mounted anywhere in the washing chamber 24, in one exemplary embodiment the transducers 200 are mounted through a floor 202 of the washing chamber 24 and direct sonic signals towards the interior of the washing chamber 24. Unlike the first embodiment with its water jets external to the washing chamber, the present embodiment uses ultrasonic vibrations that causes the water to be vibrated against the silverware. The conduit 86 supplies water and detergent into the washing chamber 24 upon activation of the pump 72 and any associated valves 114, 118, 120, specifically the water and detergent is supplied directly into the washing chamber 24 rather than to the water jet 60 as in the previous embodiments. Also, the pump 72 may simply be a device to transfer water, detergent, or waste material from one location to another, or it may also be a percolator, to heat the water to a sanitizing degree before depositing said heated water in the washing chamber 24. In addition, at least one overflow hole 206 may be provided to communicate through the washing chamber 24, proximate the open top 42, to the sump 30 to provide a path for overflowing water and waste material to be safely and sanitarily disposed of.

The microprocessor 98 is included to operate at least the transducers 200 and pump 72 and is governed by software, such as an exemplary washing cycle described below, stored in a data storage device 99. This program stored in the data storage device 99 contains information such as, the duration of each of the transducer activations of the multiple stages of the washing cycle 210, the water fill levels for each of the stages, and the duration the pump 72 should be activated to drain water and waste material from the washing chamber 24. The washing cycle 210 and the microprocessor's role in the cycle is further detailed below. The appliance 20 may be powered by 120 VAC from a wall outlet or the like, or alternatively, to aid in its portability, the appliance 20 may be battery-powered or alternatively powered, as by solar cells and the like.

Figure 8:
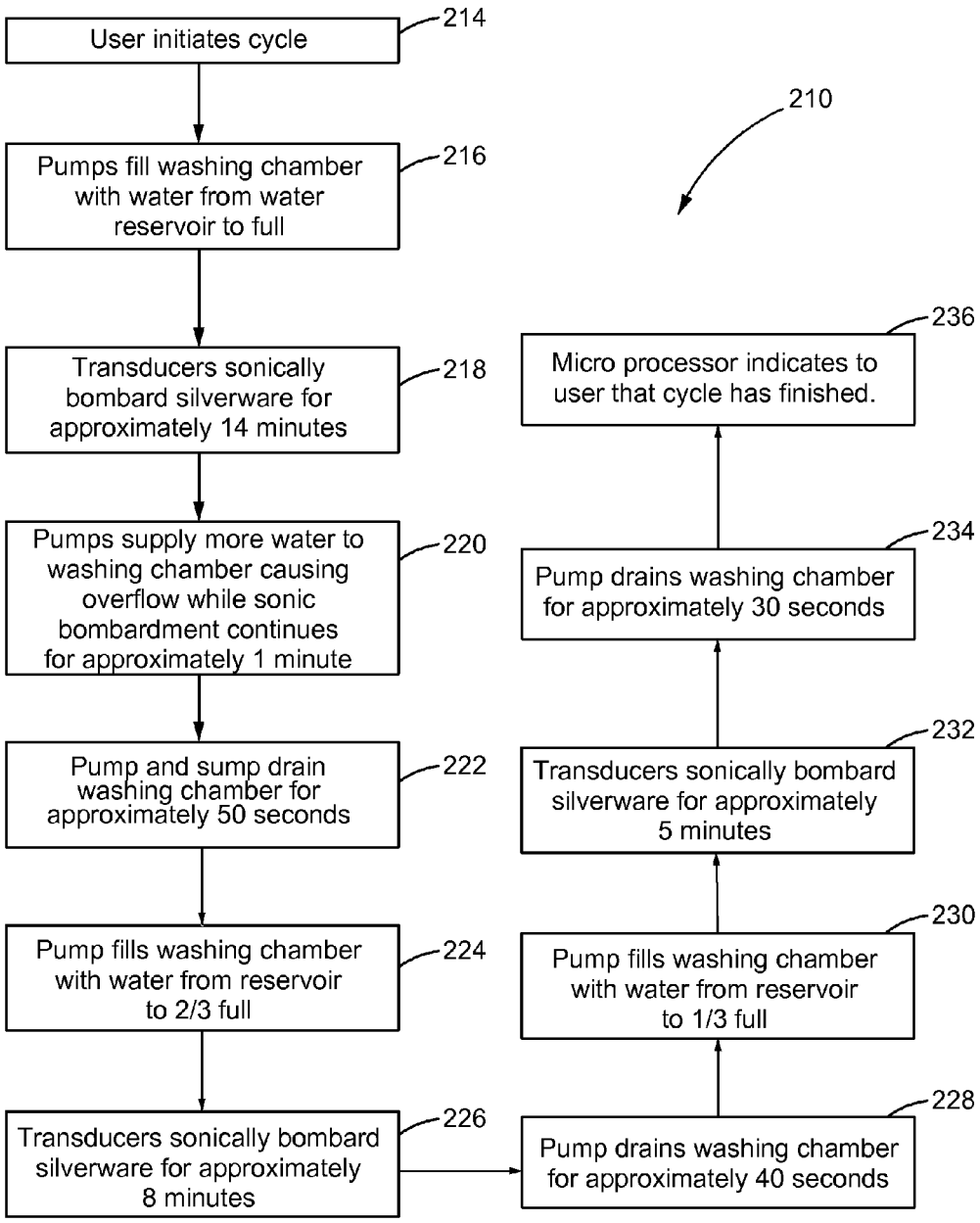
FIG. 8 is a flow chart depicting a sample sequence of steps which may be performed by a sonic appliance constructed in accordance with the teachings of the disclosure.

The sample operational washing cycle 210 for an appliance 20 utilizing transducers 200 is detailed in FIG. 8. Before the cycle 210 can begin, a user must first fill the water reservoir 26, detergent reservoir 28, and place the basket 34 of silverware in the washing chamber 24. As a user end 212 of the silverware (e.g. tines of a fork, blade of a knife, etc.) is typically the dirtiest part of the silverware and requires the most attention during cleaning, it is thus suggested for the silverware to be placed in the basket 34 with the user end 212 down, as shown in FIG. 7. This will allow the appliance 20 to focus on cleaning this area of the silverware throughout the cycle as detailed below. As indicated in the first block 214 of the cycle 210, the cycle 210 is initiated by a user actuating a start function. This may be accomplished through actuation of the switch 130, which may be provided on the interface module 100 or as a stand-alone element. The microprocessor 98 then directs the pump 72 to fill the washing chamber 24 with water from the water reservoir 26 to a pre-programmed full level in a step 216. This full level is sufficiently high to fully submerge any silverware in the basket 34, but not so high as to overflow the washing chamber 24. Once the tub 202 is full, the pump 72 is disengaged and the transducers 200 are activated by the microprocessor 98 in a step 218. In one exemplary step 218, this first sonic bombardment lasts approximately fifteen minutes, but other durations are certainly possible.

Near the end of the first sonic bombardment, in a step 220, the microprocessor 98 directs the pump 72 to supply water to the washing chamber 24 from the water reservoir 26 for the remainder of the first sonic bombardment, for example, the final minute in the exemplary fifteen minute bombardment. This causes oils and waste material that has floated to the top of the washing chamber 24 to overflow the washing chamber 24 through the overflow hole 206, allowing the water to be drained from the washing chamber 24 in step 222 without depositing the unwanted material on the silverware. As the washing chamber 24 is drained of water, the microprocessor 28 also directs the pump 72 to activate the sump 30 and remove the material and water that has overflowed the washing chamber 24 through the overflow hole 206. In one exemplary step 222, the draining step lasts for approximately fifty seconds, although other durations are certainly possible.

Once the draining step 222 has finished, the microprocessor 98, in a step 224, directs the pump 72 to fill the washing chamber 24 with water from the water reservoir 26 to another level, such as approximately two-thirds of the full level. At this point, the microprocessor 98 directs the pump 72 to cease operation and activates the transducers 200 to sonically bombard the silverware for a second time, as indicated in step 226. As indicated above, since the user end 212 is most often the dirtiest, by filling the washing chamber 24 only two thirds full, the user end 212 is submerged, but water is not wasted on the likely already cleaned handle 227. In one exemplary second sonic bombardment, the bombardment lasts for approximately eight minutes, although other durations are possible. After the preset time for the second sonic bombardment of step 226, the microprocessor 98 directs the transducers to cease function and activates the pump to drain the washing chamber 24 of water and waste material in a step 228. In one exemplary drainage step 228, the pump 72 is active for approximately forty seconds. Of course, other durations are certainly possible.

After completing step 228, the microprocessor 98 directs the pump to fill the washing chamber 24 to yet another level, such as approximately one-third full, primarily submerging the user end 212 of the silverware as, again, the user end 212 is likely the dirtiest. By only filing the washing chamber 24 a third of the way, not only is water conserved, but the cleaning process can be focused on the area which most needs cleaning. While the foregoing has been written to describe three distinct stages of filling to different volumes, it is to be understood that more or less stages, to more or less filling volumes, are certainly possible and encompassed with this disclosure.

In a next step 232 the microprocessor 98 activates the transducers 200 to sonically bombard the silverware for a third time. One exemplary third sonic bombardment may last for approximately five minutes, although other durations are possible. After the third sonic bombardment of step 232, the microprocessor 98 directs the pump 72 to drain the washing chamber 24 for the final time in a step 234. In one exemplary drainage step 234, the pump 72 is active for approximately thirty seconds although other durations are possible. Once the washing chamber 24 is drained, the microprocessor 98 may indicate to the user that the cycle 210 has been completed in a step 236. For instance, the microprocessor 98 may utilize the interface 100 to visually indicate to the user the cycle 210 has completed.

In the preceding sonic washing cycle steps, the pump 72 may direct the drainage water and waste material out of the appliance 20 through the drain conduit 110. Alternatively, the pump 72 may direct this water and waste material through the filter 92, allowing the filter 92 to separate out the waste material. The pump 72 may then direct the water back into the water reservoir 26 for future use.

From the foregoing, it can be seen that the teachings of the disclosure can be used to manufacture a silverware washer which is adapted to specifically wash only silverware. The appliance is manufactured to be sufficiently compact to mount on top of a countertop or be easily carried by a user. In addition, the appliance is manufactured to be relatively low cost thereby serving a substantial size of the world population unable to currently buy conventionally sized dishwashers.

Moreover, it uses an independent water supply thereby avoiding the need to connect the appliance to a fixed water supply such as a copper conduit or rubber hose. In so doing, the appliance can be truly portable. Finally, by using ultrasonic cleaning, and multiple cleaning steps wherein progressively smaller volumes of water are used, not only is water conserved, but the cleaning process can be focused on the dirtiest parts of the silverware. In addition, to result in a cleaner piece of silverware, this also assists in making the appliance truly portable in that it is not connected to a fixed water supply and efficiently using the water independently supplied by the user is of importance.

What is claimed is:

1. A method of sonically cleaning silverware, comprising:

providing a housing having a washing chamber, a water reservoir, a transducer, a basket, a pump, a sump, and a microprocessor;

loading silverware into the basket user end down;

pouring water in the water reservoir;

activating the microprocessor having a data storage device containing a program that directs the microprocessor to operate the transducer and pump in a three stage operation having a first stage, a second stage, and a third stage;

indicating to a user that the cycle has finished;

wherein the first stage includes, filling the washing chamber with water to a full level, activating the transducer to sonically bombard the silverware for a predetermined duration once the washing chamber is full, activating the pump at an end or the predetermined mind duration to overflow the washing chamber with water from the reservoir, and activating the pump and sump, once the transducer has deactivated, for a predetermined duration to drain water and waste material from the washing chamber;

wherein the second stage includes, activating the pump to fill the washing chamber to about two-thirds of the full level with water from the reservoir, activating the transducer, once the washing chamber has received the water from the water reservoir, to sonically bombard the silverware for a predetermined duration, activating the pump, once the transducer has deactivated, for a predetermined duration to drain water and waste material from the washing chamber; and wherein the third stage includes, activating the pump to fill the washing chamber to about one-third of the full level with water from the reservoir, activating the transducers, once the washing chamber has received the water from the water reservoir, to sonically bombard the silverware for a predetermined duration, activating the pump, once the transducer has deactivated, for a predetermined duration to drain the washing chamber of water and waste material.

2. The method of claim 1, wherein power is provided to the microprocessor, pump, and transducer from a removable battery.

3. The method of claim 1, wherein the step of indicating to a user that the cycle has finished includes the microprocessor displaying a visual indicator on a user interface.

4. A method of sonically cleaning silverware, comprising:

providing a housing having a washing chamber, a water reservoir, a transducer, a basket, and a pump;

loading silverware into the basket;

pouring water in the reservoir;

sonically cleaning the silverware in three stages, each of a first stage, a second stage, and a third stage consisting of adding water to the washing chamber, activating the transducer to sonically bombard the silverware, and activating the pump to drain the water and waste material wherein the first stage further includes, activating the pump to add water to the washing chamber from the water reservoir to overflow the washing chamber.

5. The method of claim 4, further comprising filling the washing chamber to a predetermined full level during the first stage, to two-thirds of the full level during the second stage, and to one-third of the full level during the third stage.

6. The method of claim 4, wherein the steps of activating the pump and transducer is controlled by a microprocessor acting based on a program stored in a data storage device associated with the microprocessor.

7. The method of claim 6, wherein the microprocessor activates the transducer for fifteen minutes during the first stage, eight minutes during the second stage, and five minutes during the third stage.

8. The method of claim 6, wherein the microprocessor activates the pump to drain the water and waste material for fifty seconds during the first stage, forty seconds during the second stage, and thirty seconds during the third stage.

9. The method of claim 4, wherein the pump is activated to supply water to the washing chamber from the water reservoir during each of the first, second, and third stages.

10. The method of claim 4, wherein a user manually pours water in the washing chamber during the first stage before the transducers are activated and the pump is activated to supply water to the washing chamber from the water reservoir during the second and third stages.

11. The method of claim 4, wherein the pump is activated to overflow the washing chamber while the transducer is active.

12. The method of claim 11, wherein the pump is activated to overflow the washing chamber for the last sixty seconds of the transducer activation.

13. The method of claim 4, wherein the silverware is loaded into the basket, user end down.

* * * * *